US005740982A

United States Patent [19]

Kaufmann

[11] Patent Number: 5,740,982

[45] Date of Patent: Apr. 21, 1998

[54] APPARATUS FOR PRODUCING A SPLICE BETWEEN STRIPS ON SUCCEEDING REELS

[75] Inventor: Bernd Kaufmann, Heidenheim, Germany

[73] Assignee: Voith Sulzer Papiermaschinen GmbH, Germany

[21] Appl. No.: 377,926

[22] Filed: Jan. 25, 1995

[30] Foreign Application Priority Data

Jan. 25, 1994 [DE] Germany ..... 44 01 963.7

[51] Int. Cl.[6] ..... B65H 21/00; B65H 19/18; B31F 5/00

[52] U.S. Cl. ..... 242/555.3; 242/554.2; 242/556; 156/502

[58] Field of Search ..... 42/551, 556, 555.3, 42/555.4, 554.2; 156/502, 504

[56] References Cited

U.S. PATENT DOCUMENTS

| | | | |
|---|---|---|---|
| 4,681,274 | 7/1987 | Thievessen et al. | 242/551 |
| 4,881,695 | 11/1989 | Beisswanger | 242/559 X |
| 4,892,263 | 1/1990 | Beisswanger | 242/559 X |
| 5,020,736 | 6/1991 | Thievessen | 242/556 X |
| 5,288,034 | 2/1994 | Schonmeier et al. | 242/551 |

FOREIGN PATENT DOCUMENTS

| | | |
|---|---|---|
| 3440107 | 5/1986 | Germany . |
| 3901854 | 7/1990 | Germany . |

*Primary Examiner*—John Q. Nguyen
*Attorney, Agent, or Firm*—Ostrolenk, Faber, Gerb & Soffen, LLP

[57] ABSTRACT

Apparatus for splicing the end of a terminating reel to the outer layer of a subsequent reel: a splicing tube is either swingable or reciprocable to move between a waiting position out of contact with the strip to be cut and an operating position where the splicing tube moves transversely to and into contact with the strip and moves the strip to a position where it can be cut by a knife. A knife movable between a waiting position where it will not cut the strip and a cutting position where movement of the splicing tube to the operating position moves the strip to contact the knife for cutting. The knife is supported to be moved between its positions either by swinging or by movement along a guide path. The splicing tube includes a vacuum zone which holds the strip to it, and the splicing tube is rotatable on its axis for maintaining the tension of the strip.

23 Claims, 5 Drawing Sheets

APPARATUS FOR PRODUCING A SPLICE BETWEEN STRIPS ON SUCCEEDING REELS

BACKGROUND OF THE INVENTION

The present invention relates to apparatus for cutting and then splicing the strip end of a terminating reel to the outer layer of the following reel using a splicing tube in cooperation with a knife.

Such a device, known from EP 462 157 B1, includes a cutting knife on the splicer. The splicer is developed as a slender hollow cylinder having a suction zone for holding the strip to the splicing element. The cutting knife is arranged in a groove in the splicing element. The cutting knife has an actuating device which is placed in motion upon the cutting. The splicing element has a relatively complicated construction which relatively greatly weakens it with respect to stresses, since the knife groove interrupts the cylindrical shell.

Federal Republic of Germany 34 40 107 C2 (U.S. Pat. No. 4,681,274) describes a device for connecting the end of an unwinding strip of material with the start of a second strip. It includes a knife which is arranged apart from the splicing element. The knife is moved against a tensioned section of the first strip.

Federal Republic of Germany 39 01 854 A1 (U.S. Pat. No. 5,020,736) describes a similar device in which the strip is moved against the cutting edge of a cutting device. The cutting device and the splicing element are arranged apart from each other.

SUMMARY OF THE INVENTION

It is an object of the present invention to provide a splicing device which is of relatively simple construction. The invention includes a splicing tube which holds the trailing end region of one strip by suction and moves that end region to a cutting knife, which cuts the strip then under tension. The suction zone on the tube holds the cut trailing end and moves it onto an adhesive splice region on the next installed reel where the splice is then made.

The splicing element is of very simple construction, essentially comprising a cylindrical tube which is provided with a suction zone in a region around its wall. The tube is of great flexural stiffness so that it can be made with a relatively small diameter. This produces a considerable saving in weight. The actuating device of the cutting knife can also be made very strong, sturdy and simply. For repair, it is not necessary to carry out cumbersome preparations, and replacement of the cutting knife can be effected relatively easily and rapidly.

Other features and advantages of the present invention will become apparent from the following description of the invention which refers to the accompanying drawings.

DETAILED DESCRIPTION OF EMBODIMENTS OF THE INVENTION

Figure 1:
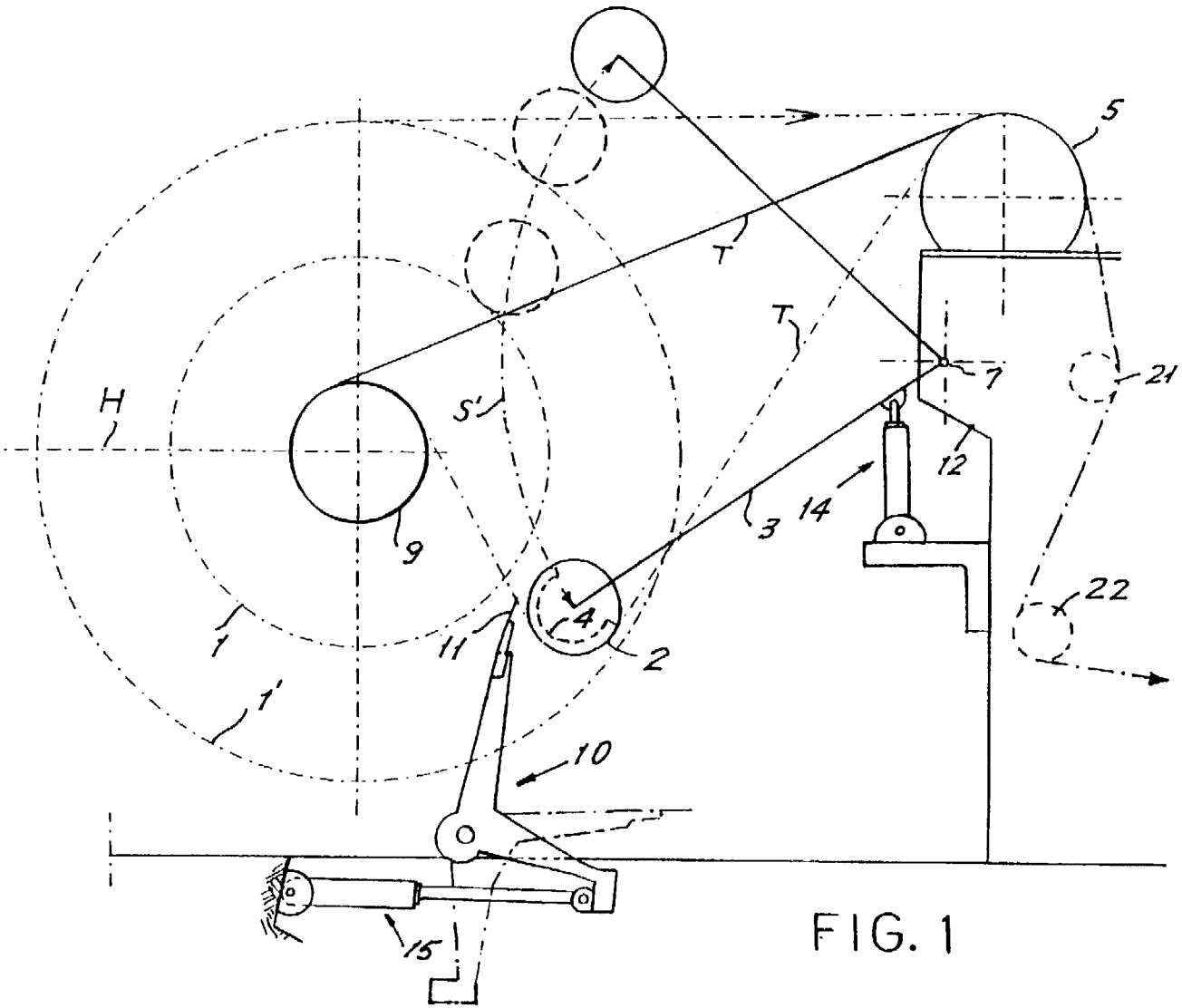
FIG. 1 is a schematic side view of a first embodiment of an apparatus for producing a splice between strips on successive reels.

In FIG. 1, the drum or reel is shown by two dash-dot circles 1 and 1', the reel 1' has the largest circumference. Each reel is supported at a rotation axis on a support. The strip or web T has unwound from the old strip reel 9, which is now stationary. The strip is moved transversely of its length by being contacted by the moving splicing element 2.

The splicing element 2 is indicated as a tubular cylinder, which has a suction zone 4 which is in the form of a perforated wall or shell. During suction, the inside of the tube is placed under vacuum. The corresponding vacuum connection has not been shown. Upon contacting the uncut strip end region, the suction zone holds the strip still and under tension for being cut and then retains the trailing cut end on the element 2 so that the cut end can be delivered to the next reel for there being spliced.

The splicing element 2 is rotatably supported on its own rotation axis which is parallel to and spaced apart from the reel axis. The element 2 is moved from the waiting position shown at the top in solid line through the attachment positions shown in dot-dash line and to the bottom, solid line, operating position, upon the clockwise swinging of the element 2 around the swing axis 7. The element is also swingable back to its waiting position. This swinging motion is accomplished by swing arms 3 to which the splicing element 2 is supported and the arms are pivotally fastened to the stand 12. The stand also supports the first guide roll 5 for the trailing end region of the unwinding strip to be cut. Further guide rolls 21 and 22 guide the strip on its further course.

The separate cutting device 10 includes a knife 11 and an actuating drive 15 for the knife in the form, for instance, of a hydraulic stroke mechanism for swinging the knife around a respective pivot axis. The pivot axis for the knife is below the horizontal plane H through the reel axis and outside the reel periphery. The waiting position of the splicing element and the swing axis of that element are both above the plane H and outside the reel periphery.

The cutting device 10 is shown in its cutting, operating position in which the strip is cut via the tensioned strip itself contacting the cutting edge of the knife device which is then held stationary. This also is the operating position of the splicing element 2.

Another operating position for the splicing element is indicated in dashed line, in which the splicing element rests against the strip reel 1 of smaller diameter where it supports the cut strip end.

The uppermost position of the splicing element is its waiting or starting position. Swinging of the splicing element down from this starting position into the lower operating position along the arc S catches the strip T so that it is applied against and then held at the suction zone of the splicing element 2. The cutting process is effected by the knife 11, which has already been brought into its operating position where it remains for some time until the cutting is done.

After the strip has been cut, and upon the upward swinging of the splicing element 2 into the further operating position in which the splicing takes place with the trailing end of the cut strip, the splicing element can preferably be rotated around its own axis by a suitable tensioning drive, like a motor connected at an end of the element 2 and supported on one of the swing arms 3 so that the cut strip remains taut during the splicing process. The splicing element 2 is swung back into the upper end waiting position shown in solid line. Then a new reel is inserted into the customary mount in place of the old strip reel 9 using a known transport device, not shown. The splicing process is then carried out by swinging and applying the splicing element 2 against the circumference of the new reel. For this purpose, the leading turn of the new reel has an application of adhesive in the position where it will be contacted by the strip end held to the suction chamber of the element 2. For instance, the adhesive is in the form of a double-sided adhesive strip. The strip T' then passes substantially horizontally to the first guide roll 5.

The above device is of relatively simple construction. The maximum indicated range of swing of the swings arms 3 can readily be established by a suitable reciprocating device 14—for instance a hydraulic one. Such an arrangement results, with reverse travel of the strip from the reel and old strip reel in the case of an opposite direction of winding.

Figure 2:
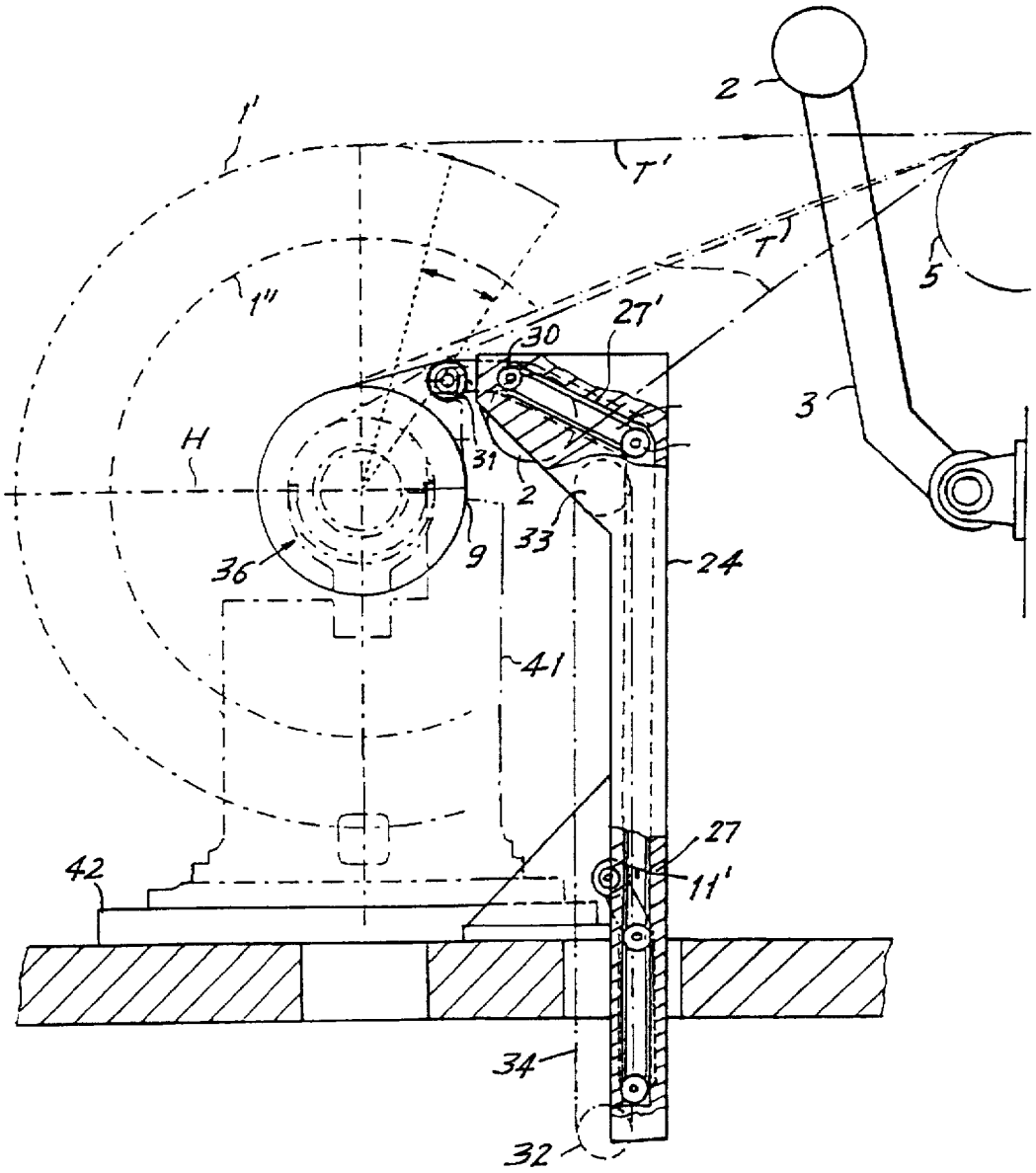
FIG. 2 is a schematic side view of a second embodiment thereof illustrating a second manner of operating the knife thereof.

The embodiment of the invention shown in FIG. 2 corresponds in principle to that shown in FIG. 1. Substantially only the knife device has been changed. For mounting the knife device, a stand 24 is provided along each lateral side of the reel. The stands include a mount 36 for the corresponding reel and the reel is located at a distance from the unwinding frame 41. The unwinding frame 41 rests on a base plate 42 of the foundation.

The knife device comprises a knife 11, an elongated rod-shaped or beam-shaped support 31 that extends across the device, and side supports 25 which hold the elongated support 31. The support 31 extends along the drum like the knife 11'. The side supports 25 are guided by rollers 29 and 30 in guide paths 27 defined in the stands 24. The drive for moving the knife is effected via a chain 34 and one of the sprockets 32 and 33 thereof via a drive motor (not shown), for instance an electric motor. The knife has its waiting position down below the reel. The upper end of the guide path 27 and, accordingly, the cutting position of the knife 11' is located above the horizontal plane H which extends through the axis of the drum. In this embodiment also, cutting is done by swinging the splicing device 2 down into the lower position indicated, and after the strip contacts the knife, the cutting is effected substantially solely due to the strip tension. Further details of the auxiliary device for moving the reel are not shown here or in FIG. 1.

Figure 3:
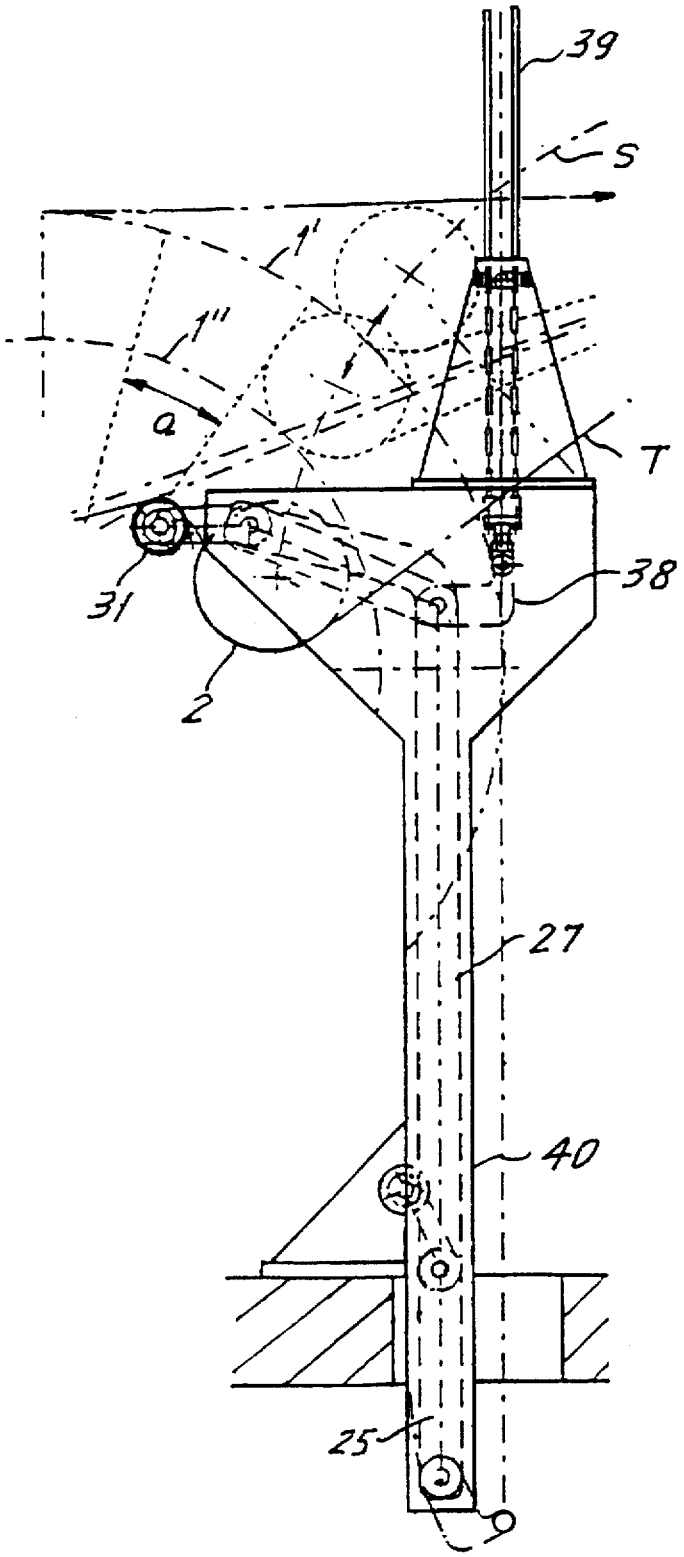
FIG. 3 is a fragmentary view of the embodiment in FIG. 2 showing an alternate manner of operating the knife.

FIG. 3 shows a similar drive means for the knife device as in FIG. 2. A chain, a rope, or else a toothed belt 40 can also be used here. The drive for the knife is effected via a hydraulic or pneumatic operating cylinder 39 and lever 38 which is fastened in each case to the side supports 25 of the knife device.

In FIGS. 2 and 3 the favorable arcuate region for the application of an adhesive strip onto the receiving roll to prepare for the splicing is indicated by the angle a. The guide paths 27, 27' and also the stands 24 are substantially vertical, and they deviate preferably at most by 30° from the vertical. This provides a very compact arrangement, which is favorable in the case of constricted space conditions, for instance due to the nature of the development of the unwinding stands. Therefore, the stands 24 are also favorably spaced from the roller stands 41, in the direction transverse to the drum 1, 1'.

Figure 4:
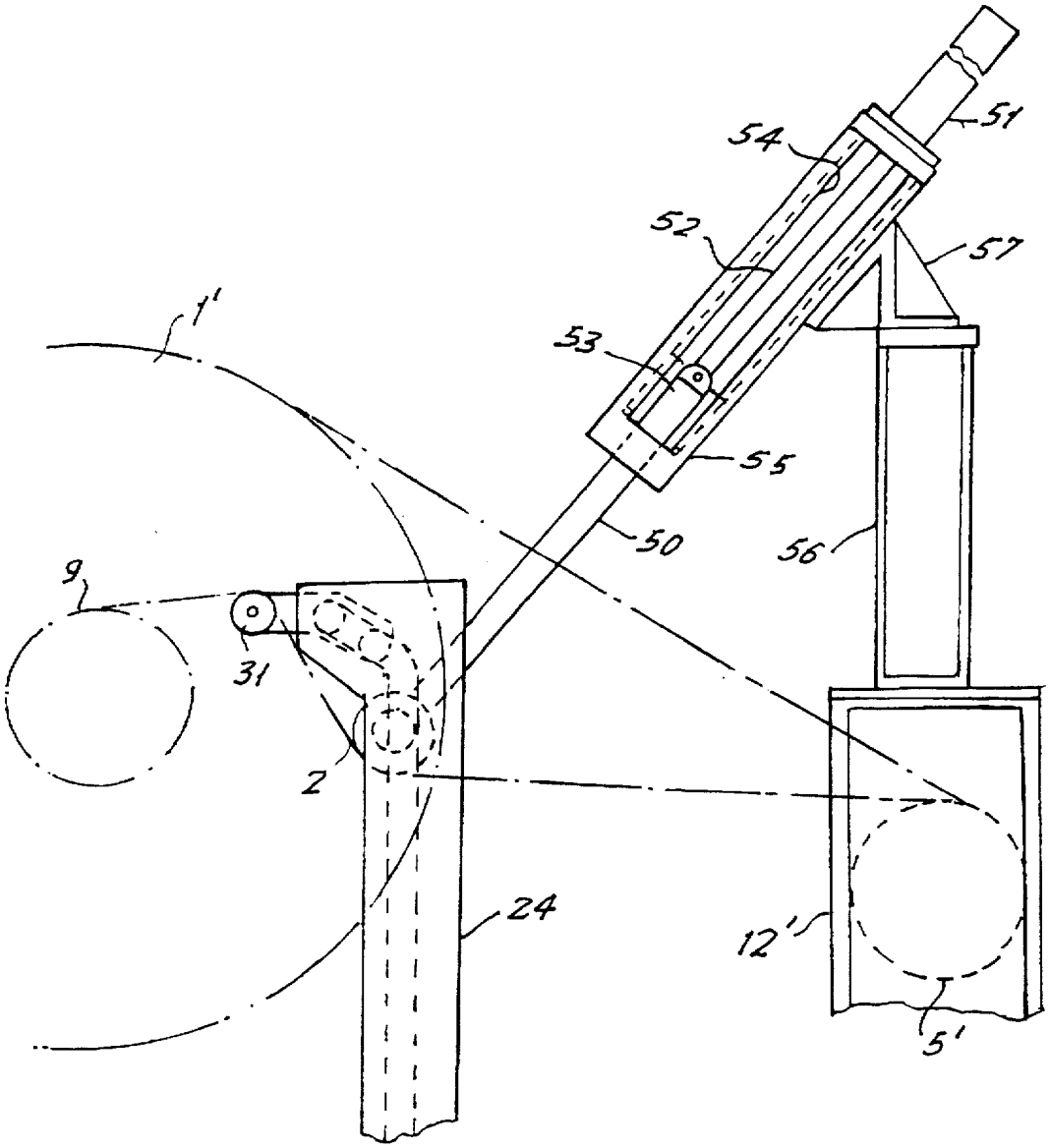
FIG. 4 is a schematic side view of a fourth embodiment of the apparatus principally showing an alternate device for moving the splicing element.

FIG. 4 shows a similar means with respect to the knife device as is shown in FIG. 2. Here, however, a different, reciprocating drive for the splicing element 2 is provided. A drive rod 50 guided by a slide carriage 53 is actuated via a holder 54 by the piston rod 52 of a hydraulic or pneumatic reciprocating element 51. The guide path of the slide shoe 53 is designated by the holder 54. The entire unit is supported by a bracket 56 with a head piece 57. The bracket rests on a stand 12', which also receives the first guide roller 5' for the strip.

Figure 5:
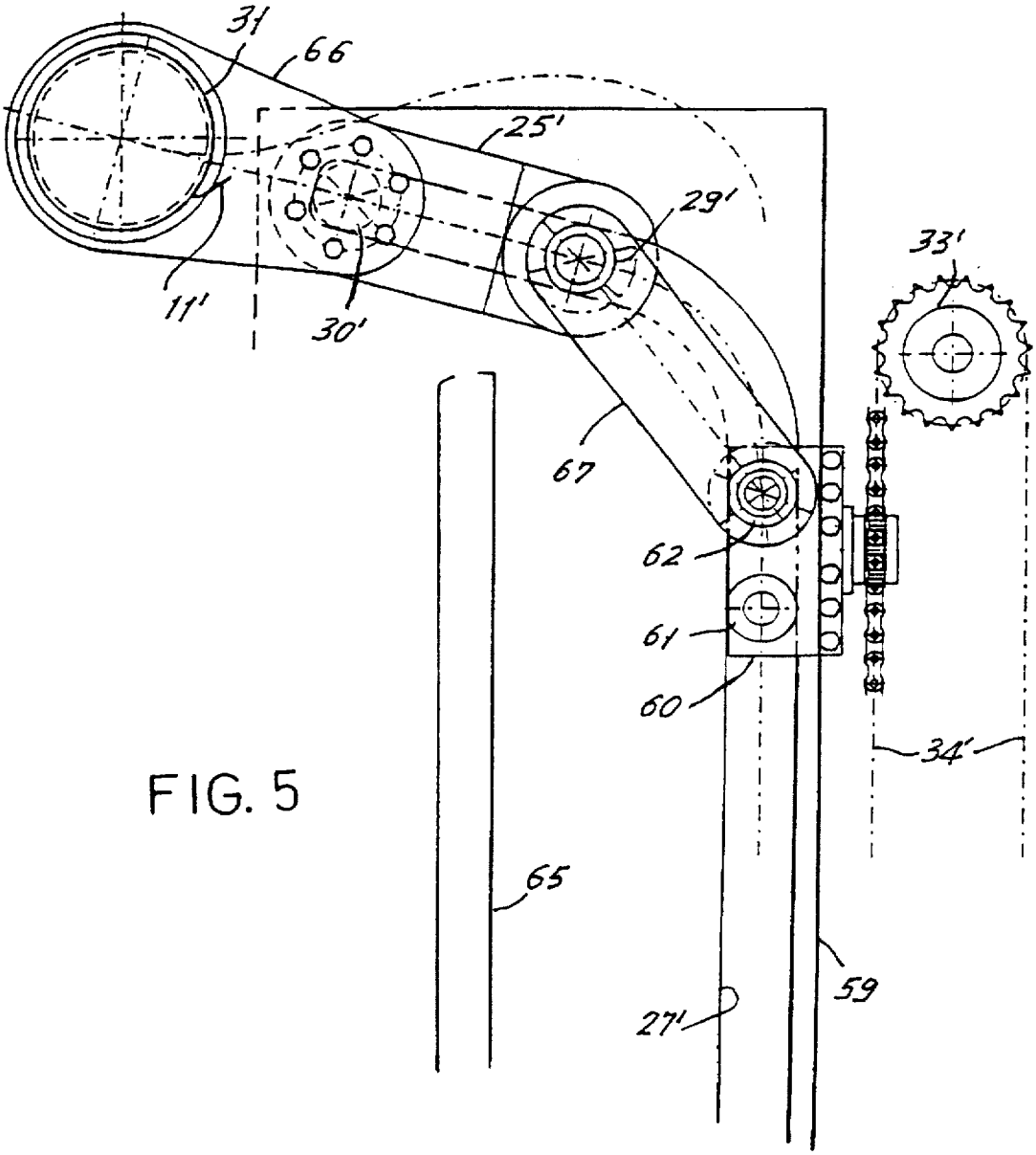
FIG. 5 is a schematic side view of another embodiment of a device for operating the knife of the splice apparatus.

In FIG. 5, the drive of the knife device of FIG. 2 is again varied, but in a somewhat different manner. The beam-shaped knife support 31 is here developed as a tube. The side supports 25' for the knife support 31 slide on rollers 29' and 30' and are driven via a connecting strap 67 from a guide carriage 60 which is moved by rollers 61 and 62 in the guide paths 27' of the stand 59 on a chain 34'. The chain, in its turn, is driven, via a sprocket wheel (not shown) which corresponds to the sprocket wheel 33 (FIG. 2), from a motor, for instance an electric motor. The stand 59 also is imparted particular stability by a stiffening rib 65. Each side support 25 has an extension 66 on which the knife beam 31 is fastened. On both of its sides, the stand 59 can have the guide paths 27' which extend substantially up to the upper position of the guide carriage 60 shown here. Two pairs of rollers 61 and 62 engage into the guide paths 27' so that the guide carriage 60 is guided well.

The knife-actuating devices shown in FIGS. 2 to 5 have the advantage that obstacles can be circumvented by the knife. Such obstacle in practice may comprise the old strip reel 9. The guide paths cause a very favorable cutting position, which comes very close to the upper circumferential region of the strip reel 9 when it has arrived in its cutting position.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Apparatus for cutting a strip exiting a terminating reel for defining a strip end and for splicing the strip end of the terminating reel to the outer layer of a following reel, the apparatus comprising a reel support for supporting the terminating reel or the following reel, the reel having an axis at the reel support;

a splicing tube having an axis extending generally along the same direction as the reel axis; and including means for holding the strip end to the splicing tube upon contact between the holding means and the strip end after the strip end has been cut;

strip guide means for guiding the strip from the terminating reel past a position of the splicing tube and defining a path of the strip past the splicing tube;

splicing tube moving means for moving the splicing tube transversely to the path of the strip past the splicing tube which is established by the strip guide means, for moving the splicing tube between a waiting position out of contact with the strip and an operating position wherein the splicing tube engages and moves the strip; and a knife for cutting the strip and positioned between the reel and the operating position of the splicing tube so that upon the splicing tube moving to the operating position in contact with the strip, the strip is moved to a position where it can be engaged by the knife for being cut by the knife;

said operating position defining a knife cutting region wherein the knife can intersect the strip, the operating position defining the knife cutting region being non-critical with respect to the knife so that the knife can intersect the strip adjacent the splicing tube between the reel and the splicing tube at any of a plurality of positions.

2. The apparatus of claim 1, further comprising means for maintaining the tension on the strip end while holding the strip end to the splicing tube.

3. The apparatus of claim 2, wherein the means for maintaining tension on the strip end includes the splicing tube being supported on the splicing tube moving means for rotation around the axis of the splicing tube, tension being maintained on the strip when the splicing tube rotates about the axis of the splicing tube.

4. The apparatus of claim 2, wherein the splicing tube moving means comprises a swing arm on which the splicing tube is mounted and a support to which the swing arm is pivotally attached at a pivot point, whereby the swinging of the swing arm around the pivot point swings the splicing tube between the waiting and operating positions.

5. The apparatus of claim 1, wherein the splicing tube moving means comprises means for swinging the splicing tube around an axis spaced away from the reel axis and the splicing tube axis, the swinging being between the waiting and operating positions of the splicing tube.

6. The apparatus of claim 1, wherein the splicing tube moving means comprises means for reciprocatingly moving the splicing tube between the waiting and operating positions.

7. The apparatus of claim 1, further comprising knife moving means for moving the knife between the knife cutting position wherein the knife is moved to a position adjacent the splicing tube when the splicing tube moves the terminating web into cutting engagement with the knife when the splicing tube moves into the operating position, and the knife waiting position wherein the knife will not engage the web if the splicing tube moves the web to the splicing tube operating position.

8. The apparatus of claim 1, wherein the web holding means on the splicing tube comprises suction means for holding the web to the splicing tube by suction.

9. The apparatus of claim 1, further comprising means for rotating the splicing tube for maintaining tension on the cut web held to the splicing tube by the holding means.

10. The apparatus of claim 1, further comprising means for moving the knife between a cutting position of the knife nearer to the reel axis where movement of the splicing tube to the operating position thereof brings the web against the knife, and a waiting position of the knife which is further from the reel axis and in a position to be out of contact with the web and with the splicing tube supporting the web even with the splicing tube in the operating position, the knife moving means being operable for establishing the cutting position of the knife at a location between the reel axis and the splicing tube and relatively near to the splicing tube when the splicing tube is in the operating position and the strip is held by the splicing tube holding means.

11. The apparatus of claim 10, wherein the knife moving means comprises a knife support positioned so that when the knife is in the waiting position, the knife is away from the splicing tube and is outside the maximum circumference of the reel.

12. The apparatus of claim 11, wherein the knife waiting position and the splicing tube waiting position are respectively located at opposite sides of the reel axis with reference to a horizontal plane extending thorough the reel axis.

13. The apparatus of claim 12, wherein the splicing tube is supported so that the waiting position of the splicing tube is located at least toward the upper level of the reel, and the support for the knife is positioned so that the waiting position of the knife is located at least in the region of the lowest level of the reel, with both waiting positions being outside the circumference of a reel of largest diameter.

14. The apparatus of claim 1, further comprising a stand, a knife actuating device supported on the stand, the knife actuating device including a knife mount and a knife supported on the mount, the stand including a guide path defined thereon and the knife mount being movable along the guide path of the stand for moving the knife between the waiting and cutting positions.

15. The apparatus of claim 14, wherein the knife mount comprises a long bar shaped support for the knife which extends generally along the direction of the reel axis and comprises side supports for the bar shaped knife support; guide elements in the stand defining the guide path for the bar shaped support for the knife.

16. The apparatus of claim 15, wherein the guide path defined in the stand is generally vertically directed generally toward the reel axis and at a location between the reel axis and a support for the splicing tube, and the guide path is bent slightly off the vertical and toward the reel axis where the guide path approaches closest to the reel axis.

17. The apparatus of claim 16, wherein the guide path of the stand extends at an angle of at most 30° from the vertical up to the bent off region.

18. The apparatus of claim 15, further comprising drive elements connected with the bar shaped knife support moving the knife support along the guide path.

19. The apparatus of claim 18, further comprising hydraulic and pneumatic operating cylinders connected with the knife support for moving the knife support along the guide path.

20. The apparatus of claim 18, wherein the drive elements for the knife support comprise a driven chain extending along the guide path and connected with the knife support and a drive motor connecting with the chain for driving the chain to move.

21. The apparatus of claim 14, wherein the stand and the guide path thereof extend vertically upward from below the reel axis and the guide path having an upper end which is above the horizontal plane extending through the reel axis, for supporting the knife in the cutting position above that horizontal plane, such that the knife in its cutting position extends toward the upper circumferential region of the reel around the axis of the reel.

22. The apparatus of claim 1, wherein the splicing tube is rotatably mounted on the splicing tube moving means, and further comprising drive means connected to the splicing tube for rotating the splicing tube around its axis.

23. The apparatus of claim 22, wherein the splicing tube moving means further comprises support arms for supporting the splicing tube, and a stand to which the splicing tube support arms are supported;

the strip guide means is spaced from the reel axis and the support arms for the splicing tube are supported on the stand.

* * * * *